US006290104B1

(12) United States Patent
Bougamont et al.

(10) Patent No.: US 6,290,104 B1
(45) Date of Patent: Sep. 18, 2001

(54) AEROSOL DISPENSER FOR LIQUID PRODUCTS

(75) Inventors: Jean-Louis Bougamont, Eu; Hervé Lompech, Incheville; Pierre Dumont, Eu, all of (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/700,702

(22) PCT Filed: May 25, 1999

(86) PCT No.: PCT/FR99/01214

§ 371 Date: Nov. 24, 2000

§ 102(e) Date: Nov. 24, 2000

(87) PCT Pub. No.: WO99/61164

PCT Pub. Date: Dec. 2, 1999

(30) Foreign Application Priority Data

May 26, 1998 (FR) ..... 98 06577

(51) Int. Cl.[7] ..... B67D 5/42
(52) U.S. Cl. ..... 222/380; 222/383.1; 222/383.5
(58) Field of Search ..... 222/383.1, 385, 222/380

(56) References Cited

U.S. PATENT DOCUMENTS 3,086,716 * 4/1963 De Kolb ..... 222/385 X
3,379,381 * 4/1968 Decaux ..... 222/385 X
4,079,865 * 3/1978 Kutik ..... 222/385 X
4,174,056 * 11/1979 Loeffler ..... 222/383.1 X
4,225,063 * 9/1980 Ayres ..... 222/380
4,227,628 * 10/1980 Parsons ..... 222/380
4,396,132 * 8/1983 Christensen ..... 222/380 X
5,181,635 * 1/1993 Balderrama et al. ..... 222/383.1
5,425,746 * 6/1995 Montaner et al. ..... 222/383.1
5,692,650 * 12/1997 Wolter et al. ..... 222/385 X
5,709,325 * 1/1998 Renault ..... 222/383.1

* cited by examiner

*Primary Examiner*—Kenneth Bomberg
(74) *Attorney, Agent, or Firm*—Bacon & Thomas, PLLC

(57) ABSTRACT

The invention relates to a dispenser for dispensing liquids in the form of aerosols, the dispenser being of the type comprising a pump (1) engaged in sealed manner in the neck (C) of a container and provided firstly with a metering internal chamber and secondly with a spray tube (10) which projects to the outside, where it is engaged in a plunger knob (3), said spray tube (10) being suitable for being fed by the metering chamber and for communicating with a transverse ejection duct (21) equipped with a spray nozzle (22);

Figure 1A:
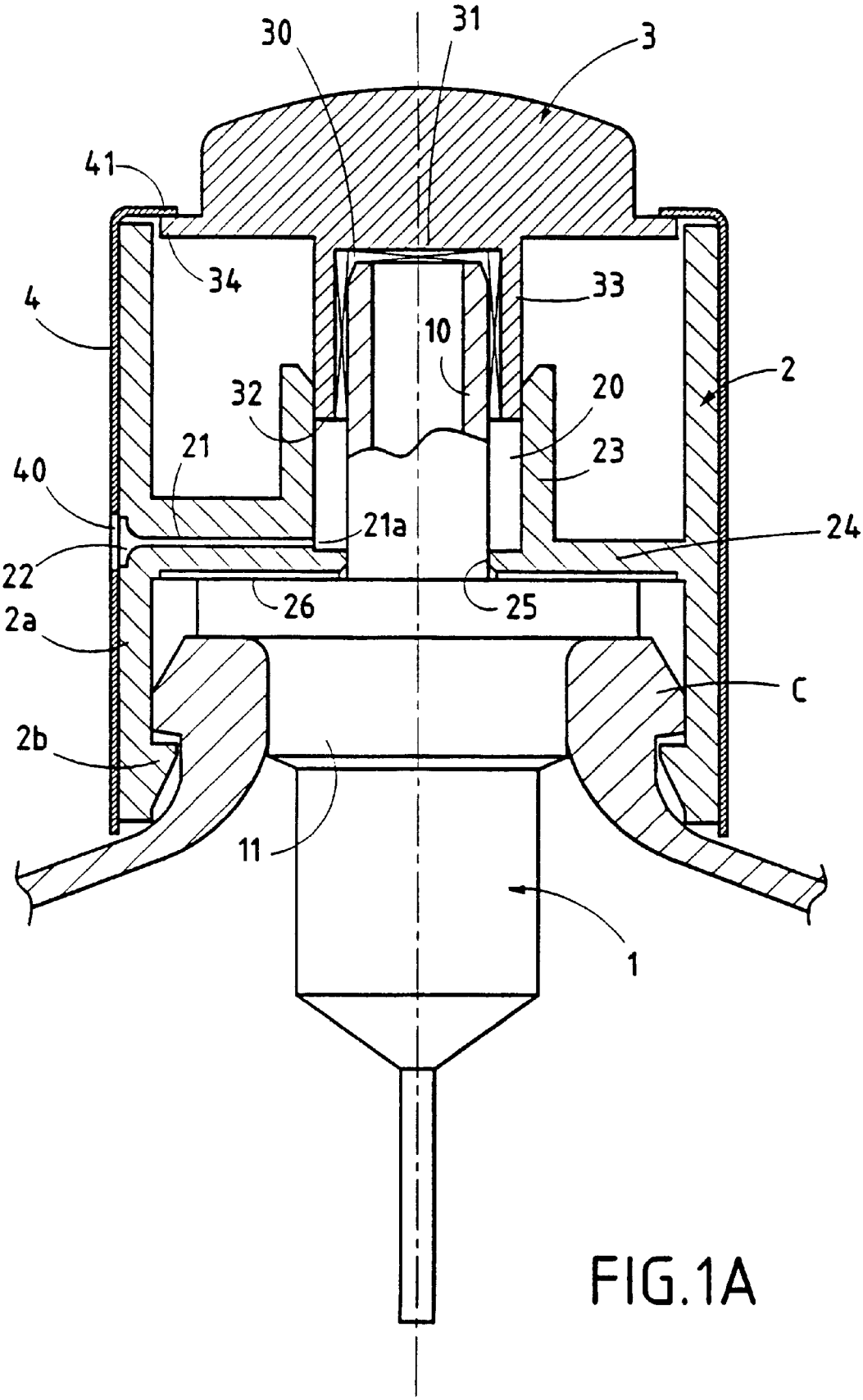

the dispenser being, upstream from the ejection duct (21), a delivery or suction external chamber (20) for delivering or for sucking in a mixture of air and of liquid, the spray tube (10) opening out into the external chamber, and the external chamber enclosing a piston (32) secured to the plunger knob (3).

14 Claims, 4 Drawing Sheets

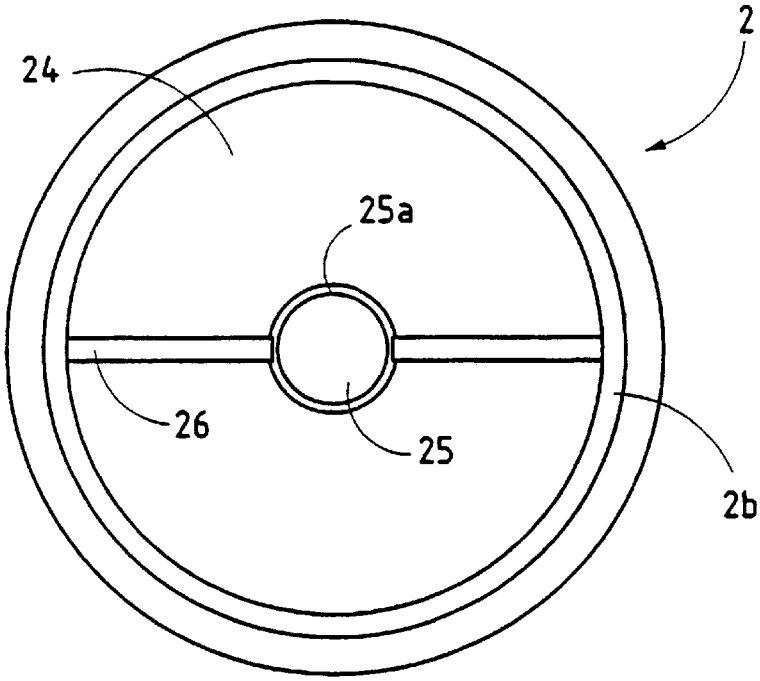
FIG.2
FIG.3
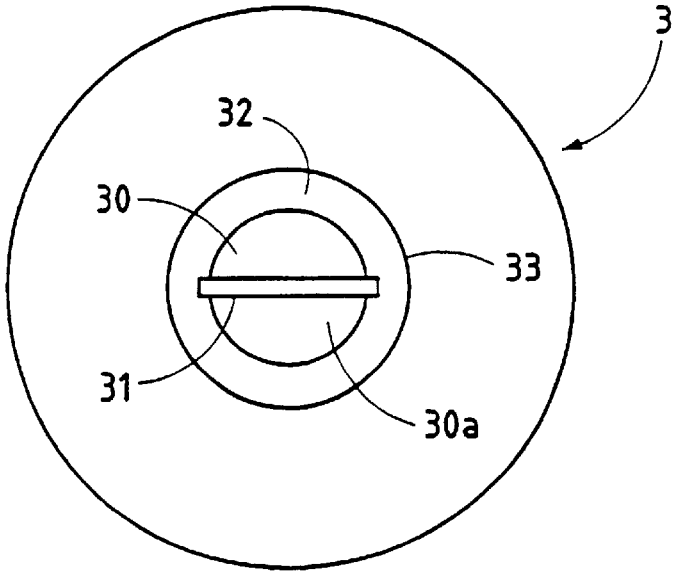

AEROSOL DISPENSER FOR LIQUID PRODUCTS

The present invention relates to a dispenser for dispensing liquids in the form of aerosols.

An existing type of dispenser comprises a pump mounted in sealed manner in the neck of a container by means of a fixing collar, and provided firstly with a metering internal chamber and secondly with a spray tube which projects to the outside where it is engaged in a plunger knob.

The spray tube is suitable for being fed by the metering chamber and for communicating with a transverse ejection duct equipped with a spray nozzle.

Sometimes, the ejection duct and the spray nozzle are formed on the plunger knob which is mounted to move axially with the spray tube.

Unfortunately, such a configuration prevents any cladding from being disposed over the top portion of the dispenser, and in particular of the pump, because such peripheral cladding would then form a screen for the spray jet, whose position varies axially.

Furthermore, in conventional dispensers, the head loss between the metering chamber and the nozzle is often large, which gives rise to spraying defects in terms both of intensity and of precision or fineness.

In addition, certain liquids require good aeration before they are dispensed. That applies in particular when a foam of finely-divided liquid is to be obtained.

Finally, with prior dispensers, it is frequent for the ejection duct and the nozzle to retain a residue of the liquid after the desired metered quantity has been sprayed.

Unfortunately, if the liquid is quick-drying (as is the case, for example, for hair lacquers and thick liquids), there is a risk that the ejection duct and/or the nozzle might be blocked by the dry residue, thereby preventing any subsequent dispensing operation.

Moreover, the presence of a residual droplet of liquid on the nozzle or in the ejection duct, i.e. in contact with the outside environment, is not aesthetically pleasing and/or can lead to contamination.

An object of the present invention is to solve those technical problems satisfactorily.

The invention achieves this object by means of a dispenser for dispensing liquids in the form of aerosols, the dispenser being of the type comprising a pump engaged in sealed manner in the neck of a container and provided firstly with a metering internal chamber and secondly with a spray tube which projects to the outside, where it is engaged in a plunger knob, said spray tube being suitable for being fed by the metering chamber and for communicating with a transverse ejection duct equipped with a spray nozzle, said dispenser being characterized in that, upstream from the ejection duct, it is provided with a delivery or suction external chamber for delivering or for sucking in a mixture of air and of liquid, the spray tube opening out into said external chamber, and said external chamber enclosing a piston secured to the plunger knob.

According to an advantageous characteristic, said delivery external chamber surrounds the spray tube coaxially.

According to another characteristic, the bottom face of the plunger knob is provided with a cylindrical bore having grooved walls and serving to cover the end portion of the spray tube while enabling the liquid to pass through towards the delivery external chamber.

According to yet another characteristic, said piston is carried by the bottom edge of a cylindrical end-piece which is preferably formed by the wall of the bottom bore of the plunger knob.

In a particular embodiment, said delivery external chamber is defined laterally firstly by the outside wall of the spray tube and secondly by the inside wall of a cylindrical sleeve carried by the collar serving to fix the pump.

In a variant, the end wall of the delivery chamber is constituted by a portion of the top face of a flange which bears axially against the pump and transversely against the outside wall of the spray tube.

More specifically, the flange forms a link spacer between the side wall of the collar and the sleeve, and preferably the ejection duct is provided in the thickness of the flange.

In another variant, the inlet orifice of the ejection duct is situated in the bottom portion of the external chamber.

In yet another variant, said piston is formed by a plane annular face with a sloping peripheral edge, optionally formed by a flexible lip.

Operation of the dispenser of the invention is optimized when the volume of said delivery chamber is equal to the volume of the metering chamber of the pump.

In a specific embodiment, the dispenser further comprises a locking collar clad externally with a ferrule which is provided firstly with an orifice coming to face the spray nozzle, and secondly with a shoulder coming into abutment against the top edge of the collar, and forming a top abutment for the plunger knob.

To this end, the plunger knob has a peripheral retaining rim held captive under the shoulder of the ferrule.

In yet another embodiment, the bottom face of the collar is provided with a groove forming a vent for the pump.

Preferably, this groove is provided in the bottom face of the flange.

The dispenser of the invention enables a metering chamber that is internal to the pump to be coupled to a delivering and mixing chamber that is external to said pump.

This coupling makes it possible to compensate the head losses due to the liquid traveling from the container to the outlet of the nozzle, and thus to guarantee a spray rate that is more vigorous.

Mixing the liquid with the air contained in the delivery external chamber is performed under pressure and thus results in better uniformity of the sprayed metered quantity.

In addition, after spraying, the plunger knob rising again under the action of the pump mechanism generates suction in the external chamber, so that any liquid remaining in the ejection duct and/or in the nozzle is sucked back in.

Thus, it is no longer necessary to clean the nozzle after spraying.

Finally, the fact that the nozzle is in a fixed position makes it possible to clad the pump with the ferrule, and also to obtain higher jet precision.

Figure 1B:
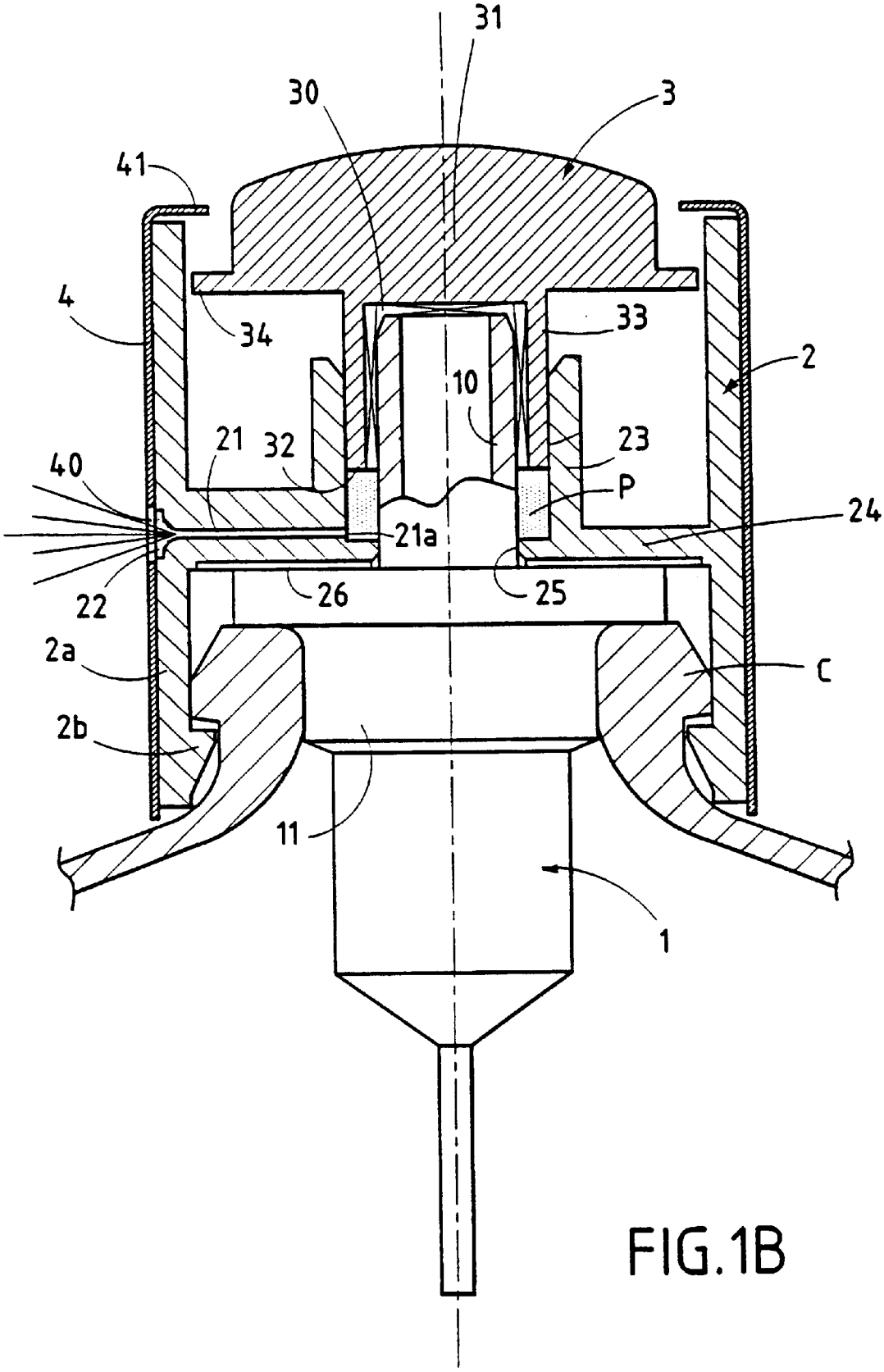
Figure 1C:
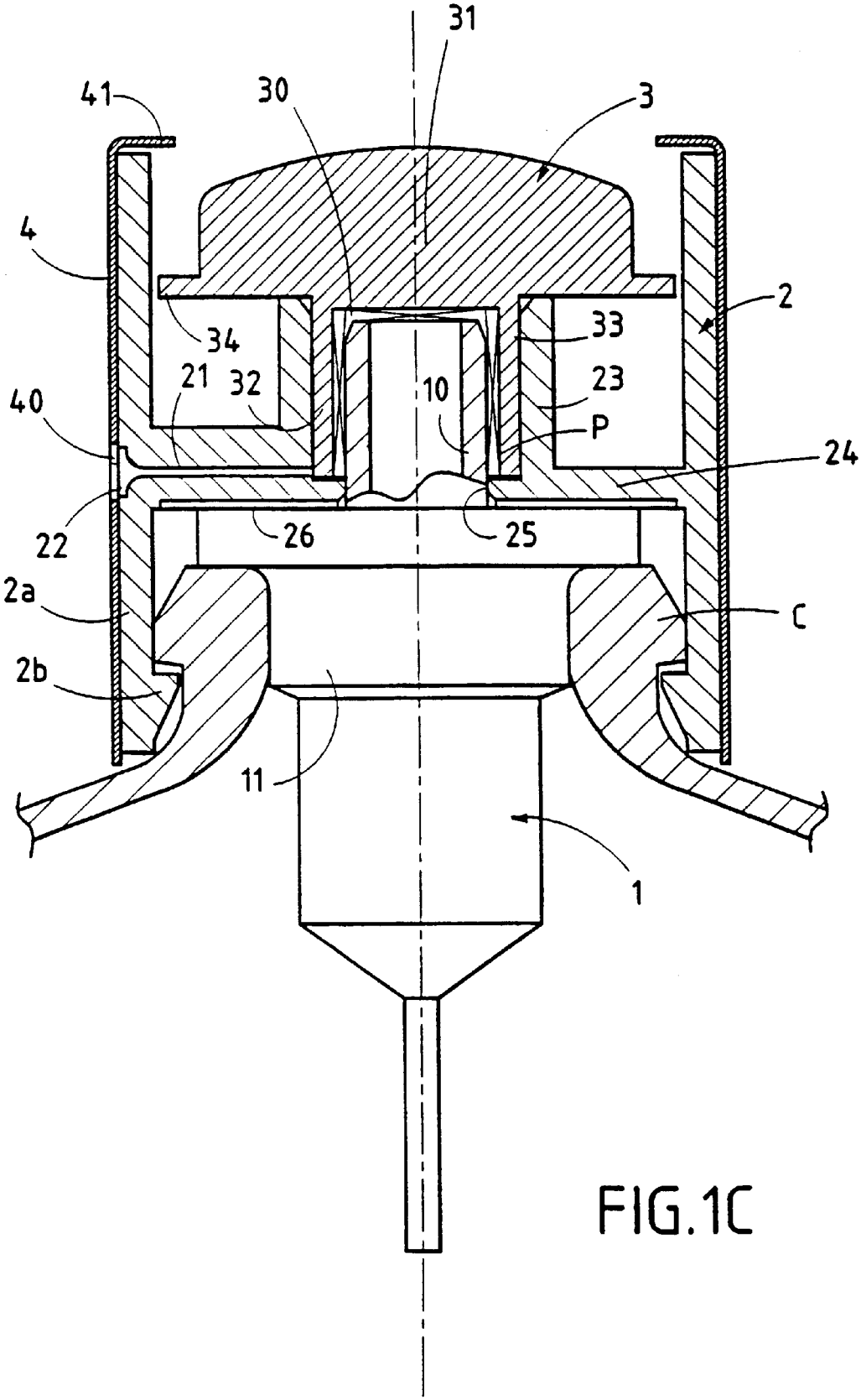

The invention will be better understood on reading the following description accompanied by the drawings, in which:

FIGS. 1*a*, 1*b*, and 1*c* are fragmentary vertical section views of an embodiment of the dispenser of the invention respectively in the rest position, and during the various stages of the spraying;

FIG. 2 is a plan view of the fixing collar used in the dispenser of the invention; and FIG. 3 is a plan view of the plunger knob used in the dispenser of the invention.

The dispenser shown in FIGS. 1*a* to 1*c* comprises a pump 1 whose body 11 that encloses the mechanism (not shown) is engaged in sealed manner in the neck C of a container of liquid P to be dispensed in the form of an aerosol (see FIG. 1*b*).

More precisely, the top portion of the body 11 of the pump is fitted into the neck C with radial clamping and it is optionally locked in this position by snap-fastening elements 2*b* on the skirt 2*a* of a collar 2 co-operating with the rim of the neck C.

In another embodiment (not shown), the pump body is of diameter smaller than the diameter of the neck, and it is fixed by locking the collar in sealed manner onto the neck.

The body 11 conventionally encloses an internal metering chamber and a piston-and-spring mechanism co-operating with inlet and outlet valves (not shown). When the pump is in the open position, the internal metering chamber opens out into a spray tube 10 whose bottom portion is secured to the piston of the pump and which projects to the outside of the container, where it is engaged in an optionally-removable plunger knob 3.

The spray tube 10 is thus suitable for being fed by the metering chamber, and for communicating with a transverse ejection duct 21 equipped with a spray nozzle 22, e.g. of the swirl type (such as a nozzle sold by SOFAB under its MICROMIST trademark).

Upstream from the ejection duct 21, the dispenser of the invention further comprises a delivery or suction chamber 20 for delivering or sucking in a mixture of air and of liquid P. The spray tube 10 opens out in the chamber 20, and said chamber encloses a piston 32 that is secured to the plunger knob 3.

The delivery chamber 20, whose volume is variable, is formed inside the collar 2 while being situated outside the pump and the container. In this example, the chamber 20 surrounds the spray tube 10 coaxially while communicating with the ejection duct 21 and with the nozzle 22.

The bottom face of the plunger knob 3 is provided with a cylindrical bore 30 having grooved walls, serving to cover the top end of the spray tube 10 while enabling the liquid P to pass through to the delivery chamber 20.

As shown in FIG. 3, a groove 31 is provided in the inside walls of the bore 30, which groove extends diametrally over the end wall 30*a* and parallel to the generator lines over the inside side face on either side of said end wall.

This configuration enables the spray tube 10 to be radially clamped in the bore 30 without hindering the discharge of the liquid P.

In the embodiment shown in the figures, the piston 32 is carried by the bottom edge of a cylindrical end-piece 33 which projects downwards from the bottom face of the plunger knob 3.

The piston 32 is formed by a plane annular face with a downwardly-sloping peripheral edge which guarantees that the inside wall of the end-piece 33 is in dynamic and sealed contact. Optionally, the sloping edge may be formed by a flexible lip.

The end-piece 33 thus forms and defines the wall of the bore 30, and it slides in the chamber 20 by compressing the mixture of air and of liquid P, as shown in FIG. 1*b*.

The external delivery chamber 20 is defined laterally firstly by the outside wall of the spray tube 10 and secondly by the inside wall of a central cylindrical sleeve 23 carried by the collar 2.

The end wall of the delivery chamber 20 is constituted by a portion of the top face of a flange 24 which bears axially against the body 11 of the pump 1 and transversely against the outside wall of the spray tube 10. An orifice 25 is provided in the center of the sleeve 23 and through the flange 24 to enable the spray tube 10 to pass through.

The inside edge of the orifice 25 is provided with a bevel facing the pump and it guarantees sealed contact with the outside wall of the tube 10 so as to avoid any leakage of the air-and-liquid mixture via the end wall of the chamber 20 during delivery.

The flange 24 also forms a link spacer between the outer skirt 2*a* of the collar 2 and the central sleeve 23.

In this example, the flange 24 is made in one-piece with the collar 2.

The ejection duct 21 is provided in the thickness of the flange 24 which is then locally strengthened. The bottom face of the flange 24 is provided with a groove 26 forming a vent for the pump 1 by communicating with the inside of the pump body as soon as said pump is actuated.

The inlet orifice 21*a* of the ejection duct 21 is preferably situated in the bottom portion of the chamber 20 in order to optimize the delivery and to ensure that the metered quantity of mixture coming from the internal chamber of the pump is expelled in full.

To the end, the height of the end-piece 33 is greater than or equal to the height of the sleeve 23.

The outside of the locking collar 2 is provided with a ferrule 4 made of anodized aluminum, for example, and provided with an orifice 40 coming to face the nozzle 22 and with a shoulder 41 coming into abutment against the top edge of the collar 2.

The shoulder 41 forms both means for positioning the ferrule 4 vertically on the collar, and also a top abutment for the plunger knob 3 which, for this purpose, is provided with a peripheral retaining rim 34 held captive under the shoulder 41 of the ferrule.

By pushing the plunger knob 3 by hand, the user acts on the mechanism of the pump 1, thereby expelling a metered quantity of liquid P from the internal chamber into the spray tube 10.

This metered quantity penetrates via the groove 31 into the external chamber 20, where, simultaneously, the air initially present is compressed by the end-piece 33 descending into the sleeve 23.

In the chamber 20, the compressed air and the metered quantity of liquid P under pressure mix, thereby generating turbulence. The end-piece 33 continuing to descend inside the sleeve 23 causes the air-and-liquid mixture to be delivered via the ejection duct 21 and to be sprayed to the outside in the form of an aerosol by the nozzle 22 via the orifice 40.

As soon as the plunger knob 3 is released, the discharge valve of the pump closes.

The end-piece 33 rising back up out of the sleeve 23 generates suction in the outer chamber 20.

This suction causes the liquid residue enclosed in the nozzle 22 and/or in the duct 21 to be sucked back through the duct 21 and to be recovered in the chamber 20.

To prevent the liquid from being degraded or contaminated by any liquid residue remaining in contact with the air in the chamber, it is possible to make provision for the walls of, in particular, the nozzle 22, the duct 21, and the chamber 20 to be made of a material containing a non-migrant bactericidal agent.

What is claimed is:

1. A dispenser for dispensing liquids in the form of aerosols, the dispenser being of the type comprising a pump (1) engaged in sealed manner in the neck (C) of a container and provided firstly with a metering internal chamber and secondly with a spray tube (10) which projects to the outside, where it is engaged in a plunger knob (3), said spray tube (10) being suitable for being fed by the metering chamber and for communicating with a transverse ejection duct (21) equipped with a spray nozzle (22);

said dispenser being characterized in that, upstream from the ejection duct (21), it is provided with a delivery or suction external chamber (20) for delivering or for sucking in a mixture of air and of liquid, the spray tube (10) opening out into said external chamber, and said external chamber enclosing a piston (32) secured to the plunger knob (3).

2. A dispenser according to claim 1, characterized in that said delivery external chamber (20) surrounds the spray tube (10) coaxially.

3. A dispenser according to claim 1, characterized in that the bottom face of the plunger knob (3) is provided with a cylindrical bore (30) having grooved walls and serving to cover the end portion of the spray tube (10) while enabling the liquid to pass through towards the delivery external chamber (20).

4. A dispenser according to claim 1, characterized in that said piston (32) is carried by the bottom edge of a cylindrical end-piece (33).

5. A dispenser according to claim 3, characterized in that said cylindrical end-piece (33) is formed by the wall of the bottom bore (30) of the plunger knob (3).

6. A dispenser according to claim 1, characterized in that said delivery external chamber (20) is defined laterally firstly by the outside wall of the spray tube (10) and secondly by the inside wall of a cylindrical sleeve (23) carried by the collar (2) serving to fix the pump (1).

7. A dispenser according to claim 1, characterized in that the end wall of the delivery chamber (20) is constituted by a portion of the top face of a flange (24) which bears axially against the pump (1) and transversely against the outside wall of the spray tube (10).

8. A dispenser according to claim 6, characterized in that the flange (24) forms a link spacer between the side wall of the collar (2) and the central sleeve (23).

9. A dispenser according to claim 7, characterized in that the ejection duct (21) is provided in the thickness of the flange (24).

10. A dispenser according to claim 1, characterized in that the inlet orifice (21*a*) of the ejection duct (21) is situated in the bottom portion of the external chamber (20).

11. A dispenser according to claim 1, characterized in that said piston (32) is formed by a plane annular face with a sloping peripheral edge.

12. A dispenser according to claim 1, characterized in that it further comprises a locking collar (2) clad externally with a ferrule (4) which is provided firstly with an orifice (40) coming to face the spray nozzle (22), and secondly with a shoulder (41) coming into abutment against the top edge of the collar (2), and forming a top abutment for the plunger knob (3).

13. A dispenser according to claim 12, characterized in that the plunger knob (3) has a peripheral retaining rim (34) held captive under the shoulder (41) of the ferrule (4).

14. A dispenser according to claim 1, characterized in that the bottom face of the collar (2) is provided with a groove (26) forming a vent for the pump (1).

* * * * *